US008555803B2

(12) United States Patent
McCormick

(10) Patent No.: US 8,555,803 B2
(45) Date of Patent: Oct. 15, 2013

(54) SYSTEMS, METHODS, AND DEVICES FOR MONITORING THE STATUS OF A DISHWASHING MACHINE

(76) Inventor: Thomas P. McCormick, Shoreline, WA (US)

( * ) Notice: Subject to any disclaimer, the term of this patent is extended or adjusted under 35 U.S.C. 154(b) by 0 days.

(21) Appl. No.: 13/226,303

(22) Filed: Sep. 6, 2011

(65) Prior Publication Data

US 2012/0060866 A1 Mar. 15, 2012

Related U.S. Application Data

(60) Provisional application No. 61/380,673, filed on Sep. 7, 2010.

(51) Int. Cl.
*A47L 15/42* (2006.01)
*B08B 3/00* (2006.01)

(52) U.S. Cl.
USPC ..... 116/200; 134/113

(58) Field of Classification Search
USPC ..... 116/109, 110, 200, 227, 228; 73/170.17, 170.18, 170.21, 170.22, 73/170.23, 290 B, 290 R, 323, 426, 427, 73/428, 429; 134/113; D10/46.2, 46.3, D10/101
See application file for complete search history.

(56) References Cited

U.S. PATENT DOCUMENTS

| | | | | | |
|---|---|---|---|---|---|
| D23,383 | S | * | 6/1894 | Cederstrom | D10/46.3 |
| 2,381,602 | A | * | 8/1945 | Larson | 73/170.17 |
| 2,821,852 | A | * | 2/1958 | Hastings | 73/170.17 |
| 2,907,206 | A | * | 10/1959 | O'Neil | 73/170.17 |
| 3,039,304 | A | * | 6/1962 | Myers | 73/170.17 |
| 3,608,514 | A | | 9/1971 | Dunn | |
| 3,698,871 | A | * | 10/1972 | Brennan | 422/53 |
| D232,859 | S | * | 9/1974 | Colquitt, Jr. | D10/70 |
| 4,109,530 | A | * | 8/1978 | Kim | 73/427 |
| 4,129,954 | A | | 12/1978 | Hulteen | |
| 4,653,423 | A | | 3/1987 | Schafer | |
| 5,044,200 | A | * | 9/1991 | Dailey et al. | 73/427 |
| D345,829 | S | | 4/1994 | Mancuso et al. | |
| 5,467,545 | A | | 11/1995 | Zillner | |
| 5,477,872 | A | | 12/1995 | Berg | |
| 5,839,458 | A | | 11/1998 | Delcarson | |
| 6,196,239 | B1 | | 3/2001 | Eskey | |
| D453,692 | S | * | 2/2002 | Addink et al. | D10/52 |
| D461,729 | S | * | 8/2002 | Addink et al. | D10/56 |
| 6,779,399 | B2 | * | 8/2004 | Liljegren et al. | 73/427 |
| D525,549 | S | * | 7/2006 | Crewz | D10/101 |
| 7,181,961 | B1 | * | 2/2007 | Hill | 73/170.17 |
| D569,186 | S | * | 5/2008 | Dickinson | D7/517 |
| 7,516,746 | B1 | | 4/2009 | Davis | |
| 2008/0017540 | A1 | * | 1/2008 | Sawhney et al. | 206/514 |
| 2011/0048128 | A1 | * | 3/2011 | Groll | 73/427 |

* cited by examiner

*Primary Examiner* — R. A. Smith

(57) ABSTRACT

The present disclosure describes various embodiments of devices and systems for monitoring the clean/dirty status of dishes inside a dishwashing machine. In one embodiment, for example, a dishwasher status indicator can include one or more vessels for holding water to visibly indicate that a dishwashing cycle is complete. In another embodiment, the indicator can include an attachment feature or portion, such as a hook attached to the vessel. The hook can be configured to removably attach the indicator to a dishwasher frame or rack. A user can quickly determine the clean/dirty status of dishes in the dishwasher by observing whether the vessel is holding water.

3 Claims, 6 Drawing Sheets

SYSTEMS, METHODS, AND DEVICES FOR MONITORING THE STATUS OF A DISHWASHING MACHINE

CROSS-REFERENCE TO RELATED APPLICATION

The present application claims priority to and the benefit of U.S. Patent Application No. 61/380,673 filed Sep. 7, 2010, titled SYSTEMS, METHODS, AND DEVICES FOR MONITORING THE STATUS OF A DISHWASHING MACHINE, which is incorporated herein by reference in its entirety.

TECHNICAL FIELD

The present disclosure relates generally to dishwashers, and more particularly, to dishwasher status indicators that indicate whether dishes in a dishwasher are dirty or clean.

BACKGROUND

Dishwasher status indicators help dishwashing machine users determine whether dishes in a dishwasher are dirty or clean. It is important to have a simple and reliable indicator because users often do not unload the entire batch of dishes after a cleaning cycle has been run; instead they often leave clean dishes in the dishwasher and unload them one at a time as they are needed. This causes confusion in the household, with household members unsure of whether the dishes in the dishwasher are clean or dirty.

Various types of dishwasher status indicators are known, such as those disclosed in U.S. Pat. Nos. 5,839,458, 6,196,239, and 5,477,872. The devices disclosed in these patents rely on moving parts to force an indicator to move from a "dirty" to a "clean" status. Furthermore, each relies on specific dish positioning or temperature changes to operate properly. The '458 and '872 patents both require that dirty dishes be positioned and weighted on the indicator device so that levers within the devices function properly. The '458 and '239 patents both require a particular temperature change in order to change the status output. These systems are complicated and not foolproof. If the moving parts fail to work together properly, or if the dishes are not loaded into the machine with the appropriate weight distribution on the indicator, or if the temperature change is insufficient, the indicator may give the user the wrong status.

Other types of dishwasher indicators, such as those disclosed in U.S. Pat. No. 5,467,545 and Des. No. 345,829 are placed on the exterior of the dishwasher and require the user to remember to take action to manually change the indicator status. One drawback of such indicators is that they require two actions—a change of the marker from "Dirty" to "Clean" after the cycle has been run, and an additional change from "Clean" to "Dirty" when the dishwasher has been unloaded. Another drawback is that they do not prompt the user with a visual trigger the same way that interior indicators do because exterior indicators are on the outside of the dishwashing machine while the user is focusing their attention on the dishes inside the dishwashing machine. Consequently, exterior indicators are often overlooked and the confusion as to whether the dishes are clean or dirty persists. It would be advantageous to provide a simple, one-step dishwasher status indicator that is located on the interior of the dishwasher, has no moving parts, and doesn't require a particular position or temperature to operate properly.

DETAILED DESCRIPTION

The present disclosure describes various embodiments of devices and systems for monitoring the clean/dirty status of dishes inside a dishwashing machine. In one embodiment, for example, a dishwasher status indicator can include one or more vessels for holding water to indicate that a dishwashing cycle has been run. As described in greater detail below, an attachment mechanism, such as a hook, can removably attach the vessel to a dishwasher frame, utensil basket, post, rack, or other feature inside the dishwasher. In another embodiment a hollow tube inside the vessel can serve as an attachment mechanism for removable positioning on a dishwasher post. In all embodiments the vessel at least partially fills with water during the dishwashing cycle, so a user can tell at a glance whether dishes in the dishwasher are clean or dirty.

Certain details are set forth in the following description and in FIGS. 1A-7 to provide a thorough understanding of various embodiments of the present disclosure. Other details describing well-known structures and systems often associated with dishwasher status indicators have not been set forth in the following disclosure to avoid unnecessarily obscuring the description of the various embodiments of the disclosure.

Many of the details, dimensions, angles and other features shown in the Figures are merely illustrative of particular embodiments of the disclosure. Accordingly, other embodiments can add other details, dimensions, angles and features without departing from the spirit or scope of the present invention. In addition, those of ordinary skill in the art will appreciate that further embodiments of the invention can be practiced without several of the details described below.

In the Figures, identical reference numbers identify identical, or at least generally similar, elements. To facilitate the discussion of any particular element, the most significant digit or digits of any reference number refers to the Figure in which that element is first introduced. For example, element 104 is first introduced and discussed with reference to FIG. 1A.

Figure 1A:
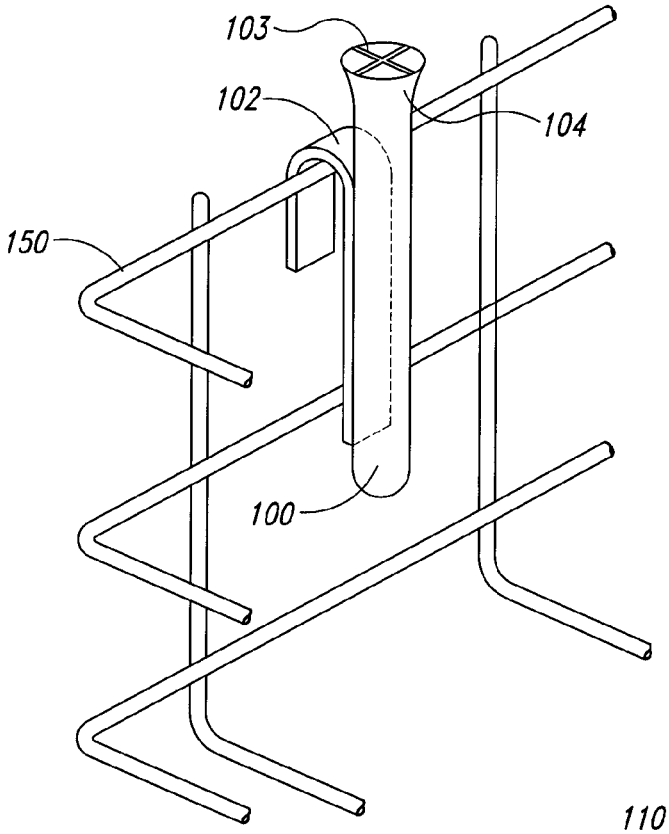
FIG. 1A is an isometric view of a dishwasher status indicator configured in accordance with an embodiment of the disclosure.
Figure 1B:
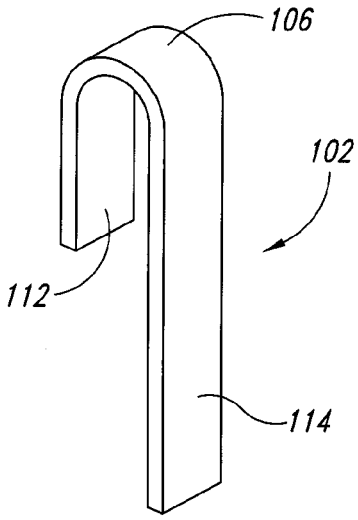
FIG. 1B is an isometric view of a hook portion of the indicator of FIG. 1A.

FIG. 1A is an isometric view of a dishwasher status indicator 100 configured in accordance with an embodiment of the invention. The indicator 100 includes a vessel portion 104 and an attachment mechanism, such as a hook portion 102, to attach the indicator 100 to a dishwasher frame or rack 150 or utensil basket. FIG. 1B is an isometric view of the hook portion 102 and FIG. 1C is an isometric view of the vessel portion 104.

Figure 1C:
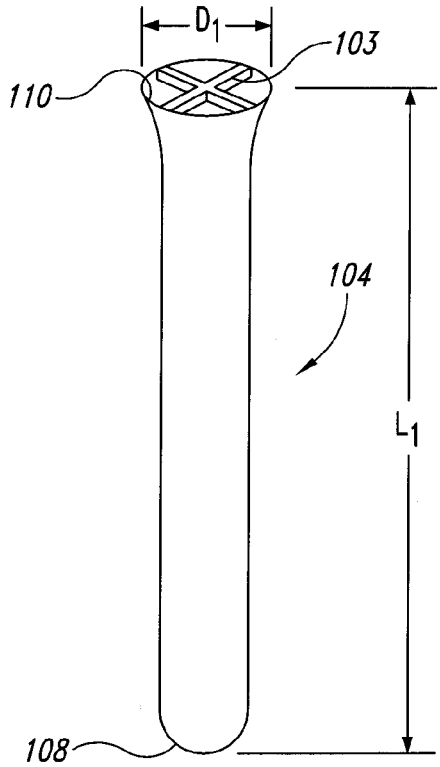
FIG. 1C is an isometric view of a vessel portion of the indicator of FIG. 1A.

Referring to FIGS. 1A-1C together, in the illustrated embodiment, the vessel 104 is test-tube shaped with a base 108 at one end and an opening 110 at the other end. In other embodiments, the vessel 104 can have other shapes and configurations. In some embodiments, for example, the vessel 104 may be cup-shaped, conical, or another shape entirely. In the illustrated embodiment, the opening 110 has a fluted shape. In other embodiments the opening 110 can have other shapes. The dimensions of the vessel 104 vary in different embodiments of the invention. In some embodiments, for example, the vessel 104 has a diameter $D_1$ ranging from about 0.4 inch to about 1.5 inches and a length $L_1$ ranging from about 2 inches to about 8 inches. In other embodiments, the vessel 104 can have other dimensions.

The hook 102 has a length on either side of a curved portion 106 and has an under side 112 and an upper side 114. In FIG. 1A, the under side 112 of the curve portion 106 of the hook 102 rests over the dishwasher rack 150. In various embodiments of the disclosure, the curved portion 106 can be a smooth curve, can have right angles or can have other configurations altogether. The hook 102 can be configured to fit loosely or snugly over the dishwasher rack 150 depending on the shape and degree of curvature of the curved portion 106.

The hook 102 may be U-shaped (having equal lengths on either side of the curve 106) or may be J-shaped (having unequal lengths on either side of the curve, as illustrated in FIGS. 1A-B). The proportion of lengths on either side of the curve 106 as well as the overall length of the hook 102 can vary in different embodiments of the disclosure. In one embodiment, the hook 102 ranges in length from about 3 inches to about 8 inches. In other embodiments of the disclosure, other systems or attachment mechanisms for attaching the vessel 104 to a dishwasher rack 150, utensil basket, post or frame can be used.

In various embodiments, the hook 102 and vessel 104 can be an injection-molded unit, manufactured using suitable methods known in the industry, or can be separate units held together by a band, clip, clasp, ring, snap, connector, adhesive, or other material or mechanism. The indicator 100 can be made of materials known in the art of kitchenware, including, for example, plastic, silicon, rubber, stainless steel or other rust-resistant metals, glass, Pyrex™, or ceramic. In some embodiments, the hook portion 102 and the vessel portion 104 are made of different materials. In one embodiment, for example, the hook 102 is made of flexible silicon and the vessel 104 is made of glass. In some embodiments, at least a portion of the vessel 104 is made of a transparent material, such as transparent plastic or glass. At least a portion of the vessel 104 can be colored (e.g., color-tinted plastic).

In the illustrated embodiment, there is a cross-shaped contraster piece 103 at the opening 110. In other embodiments the contraster piece 103 can be another shape such as a circle, square, spiral, line, set of lines, or other shape. The contraster piece 103 can be made of any of the materials discussed above, including, for example, plastic, silicon, rubber, stainless steel or other rust-resistant metals, glass, Pyrex™, or ceramic. In some embodiments the contraster piece 103 is colored. In another embodiment the contraster piece 103 is attached to the vessel 104 at a point below the opening 110. The contraster piece 103 can provide visual contrast with a volume of water in the vessel 104. As will be described in further detail below, further embodiments may employ additional or alternate contraster features to make the presence of water in the vessel (or the lack of water) visually stand out. In still further embodiments, the contraster piece 103 can be absent altogether.

The indicator 100 can be placed at any location along the rack 150, including along either an upper or lower dishwasher rack 150 of a front-loading dishwasher, or along a sole rack 150 of a top-loading dishwasher. In other embodiments, the indicator 100 can be placed on a utensil basket or other interior section, post, or door. When the dishwashing cycle is run and completed, the vessel 104 will be filled or at least partially filled with water, indicating to users of the dishwasher that the dishes are clean. In embodiments of the indicator where the vessel 104 is made of a transparent material, such as a transparent plastic or glass, the water in the vessel 104 is visible both from a side view of the vessel 104 and from a top view of the opening 110. In embodiments where the vessel 104 is not made of a transparent material, the water in the vessel 104 may only be visible from a top view of the opening 110. As described above, embodiments having a contraster piece 103 at the opening 110 give the user an additional means of reading the indicator by allowing the user to see the water level as it contrasts with or is shadowed by the contraster piece 103.

The indicator 100 with the water-filled vessel 104 is left in the dishwasher until all clean dishes have been unloaded. After all the clean dishes in the dishwasher are unloaded, the user must then empty the vessel 104 and return the indicator 100 to the dishwasher. For embodiments wherein the vessel 104 is fixedly attached to or integrated with the hook 102, emptying involves moving the entire indicator 100 to a sink or other drain and tipping the water out, or tipping the water out in the dishwasher itself. For embodiments in which the vessel 104 is removably attached to the hook 102, only the vessel portion 104 needs to be moved over a drain and emptied. When users see that the vessel 104 is empty, they know that the dishes in the dishwasher are dirty. If the dishwasher is only partially emptied (e.g., a user removes only a single clean dish that they immediately need), then the indicator 100 is not removed or emptied of water and continues to indicate that the dishes are clean.

Under this method of use, only one action is required by users: empty the vessel 104 after all dishes are unloaded and return the vessel 104 to the dishwasher. Furthermore, the required action is intuitive: users of dishwashers know that a vessel 104 full of water in a dishwasher is unusual and needs to be emptied. As long as the vessel 104 is emptied at the right time (i.e., after all clean dishes have been unloaded), the described embodiments of dishwasher status indicators 100 are foolproof. The foregoing methods of using the dishwasher status indicator 100 may be applied to other embodiments of indicators, as described below.

Figure 2:
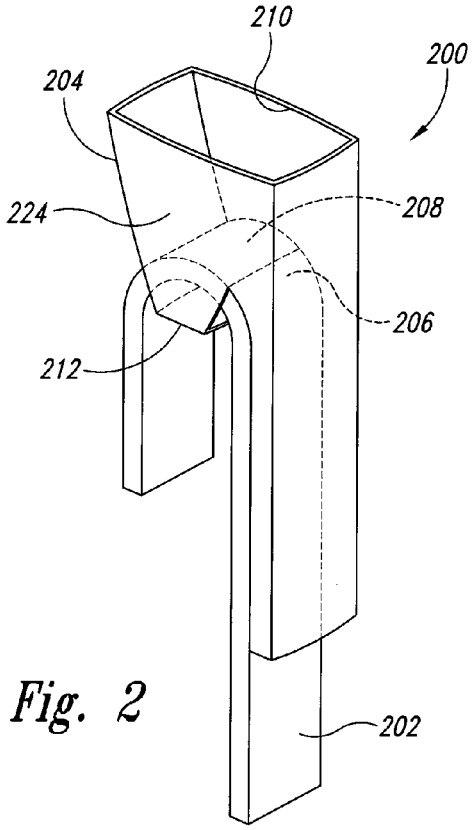
FIG. 2 is an isometric view of a dishwasher status indicator having a top vessel configured in accordance with an embodiment of the disclosure.

FIG. 2 is an isometric view of an indicator 200 having a top vessel 204 configured in accordance with another embodiment of the disclosure. In this embodiment, the vessel portion 204 of the indicator 200 can be positioned along a curve portion 206 of a hook 202. In other embodiments, attachment mechanisms other than a hook can be used. In the illustrated embodiment, the vessel 204 has side walls 224, a base portion 208, and an opening 210. In some embodiments, the vessel 204 can extend along a portion of the length of the hook. In other embodiments, the vessel 204 and/or the opening 210 can take on other shapes. The vessel 204 can be attached to the hook 202 by any of the materials or mechanisms discussed above with reference to FIG. 1. The vessel 204 can be fixedly or removably attached to the hook 202. In the illustrated embodiment, an undersection portion 212 of the vessel 204 wraps around and attaches to the under side of a curve portion 206 of the hook 202. In other embodiments, the vessel 204 does not have this undersection 212 and attaches only to the upper side of the hook 202. In still further embodiments, the vessel 204 may be molded with the hook 202 as a single unit. The indicator 200 can be positioned in the dishwasher in various manners as described above with reference to the indicator 100.

Figure 3:
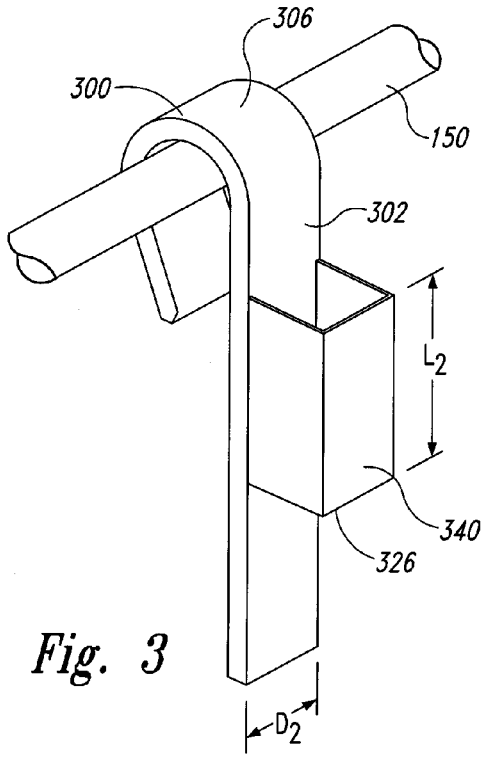
FIG. 3 is an isometric view of an indicator having a holder portion configured in accordance with another embodiment of the disclosure.

FIG. 3 is an isometric view of a hook portion 302 and a holder portion 340 of an indicator 300 configured in accordance with another embodiment of the present disclosure. The hook portion 302 has the same structure and function as the hook 102 described with reference to FIGS. 1A-B above. The hook 302 can be configured to fit loosely or snugly over the dishwasher rack 150 depending on the shape and degree of curvature of the hook 302. In other embodiments, attachment mechanisms other than a hook may be used. The holder 340 is attached to the hook 302 and is configured to releasably support a vessel (such as the vessel 104 described with reference to FIG. 1) in an upright orientation. The holder 340 may be integrally formed with the hook 302 or may be fixedly or removably attached using any attachment material or mechanisms known in the art, such as adhesive, connectors, snaps, solder, tape, string, or other means. In the illustrated embodiment, the holder 340 is a square-shaped member through which the vessel protrudes. The holder 340 can have a width $D_2$ approximately equal to, or slightly larger than, the diameter $D_1$ of the vessel 104. In further embodiments, the holder 340 can have a width $D_2$ slightly smaller than the diameter of a fluted portion or lip of the vessel 104, but slightly larger than the diameter of a non-fluted or non-lipped portion of the vessel 104. In still further embodiments, the holder 340 can take on a circular, oval, triangular, rectangular, or other shape.

The holder 340 supports the vessel either by friction (preventing the vessel from sliding very far through the holder 340), or by catching a lip, a ledge, or a fluted portion of the vessel 104 (preventing the lip, ledge, or fluted portion from sliding through the holder 340). In an alternate embodiment, the holder 340 is a blind hole. In this embodiment, the vessel again slides into the holder 340, but does not protrude through a bottom side 326 of the holder 340. Rather, the bottom side 326 of the holder 240 supports the base 108 of the vessel. In certain embodiments, there can be apertures (not pictured) positioned on the bottom side 326 of the holder 340 which can drain water accumulated in the holder 340 during the dishwashing cycle. In other embodiments, these apertures are absent.

In any of these embodiments, the holder 340 can be made of any of the materials discussed above with reference to the hook 102 or vessel 104. The holder 340 may be positioned at any point along the length of the hook 302 so long as when the vessel is placed within the holder 340, the vessel is in a generally vertical orientation. That is, the holder 340 cannot be placed entirely on a curve portion 306 of the hook 302 because such placement would cause the vessel placed within the holder 340 to have a slanted or horizontal orientation. The holder 340 may take on a length $L_2$ ranging from about 0.1 inch to around the length $L_1$ of the vessel 104. The indicator 300 can be positioned in the dishwasher in various manners as described above with reference to indicator 100.

Figure 4:
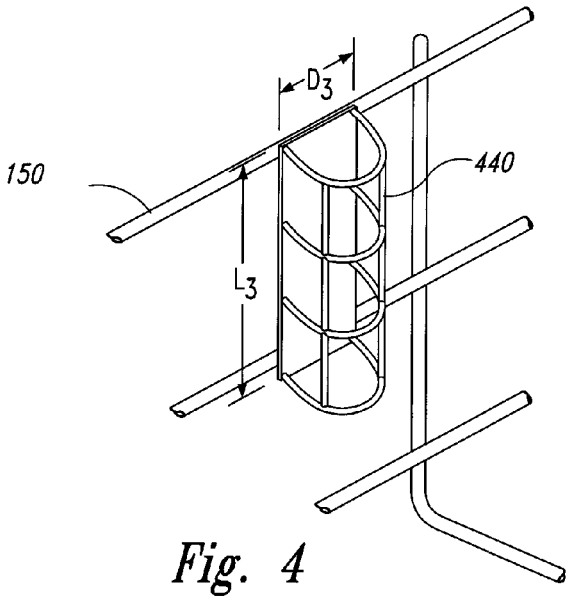
FIG. 4 is an isometric view of a holder portion attached to a dishwasher rack in accordance with a further embodiment of the disclosure.

FIG. 4 is an isometric view of a holder 440 attached to a dishwasher rack 150 in accordance with an embodiment of the disclosure. The holder 440 may be integrally formed with the rack 150 or may be fixedly attached or removably attached to the rack 150 by any attachment mechanisms known in the art, including, for example, adhesive, screws, snaps, connectors, or other materials or mechanisms. In other embodiments the holder 440 can be permanently integrated with the dishwasher structure. The holder 440 can be made of any of the materials discussed above with reference to the holder 340 illustrated in FIG. 3 and may have the diameter $D_3$ and length $L_3$ dimensions as described above. The holder 440 is configured to support a vessel (such as the vessel 104 described with reference to FIG. 1) in the same way as discussed above with reference to FIG. 3. The holder 440 in this embodiment can again be a square, a ring, or another shape and may be a through-hole or a blind hole. The holder 440 may be positioned on any portion of the rack 150 or may be positioned on another portion of the dishwasher structure, such as on a utensil container, or may be positioned on the dishwasher machine itself (e.g., on an interior door or wall of the dishwasher). In the illustrated embodiment, the holder 440 has a grated structure, similar to grated structures typically used on dishwasher racks 150 or dishwasher utensil containers. In other embodiments, however, the holder 440 can have a non-grated or a partially-grated structure.

Figure 5:
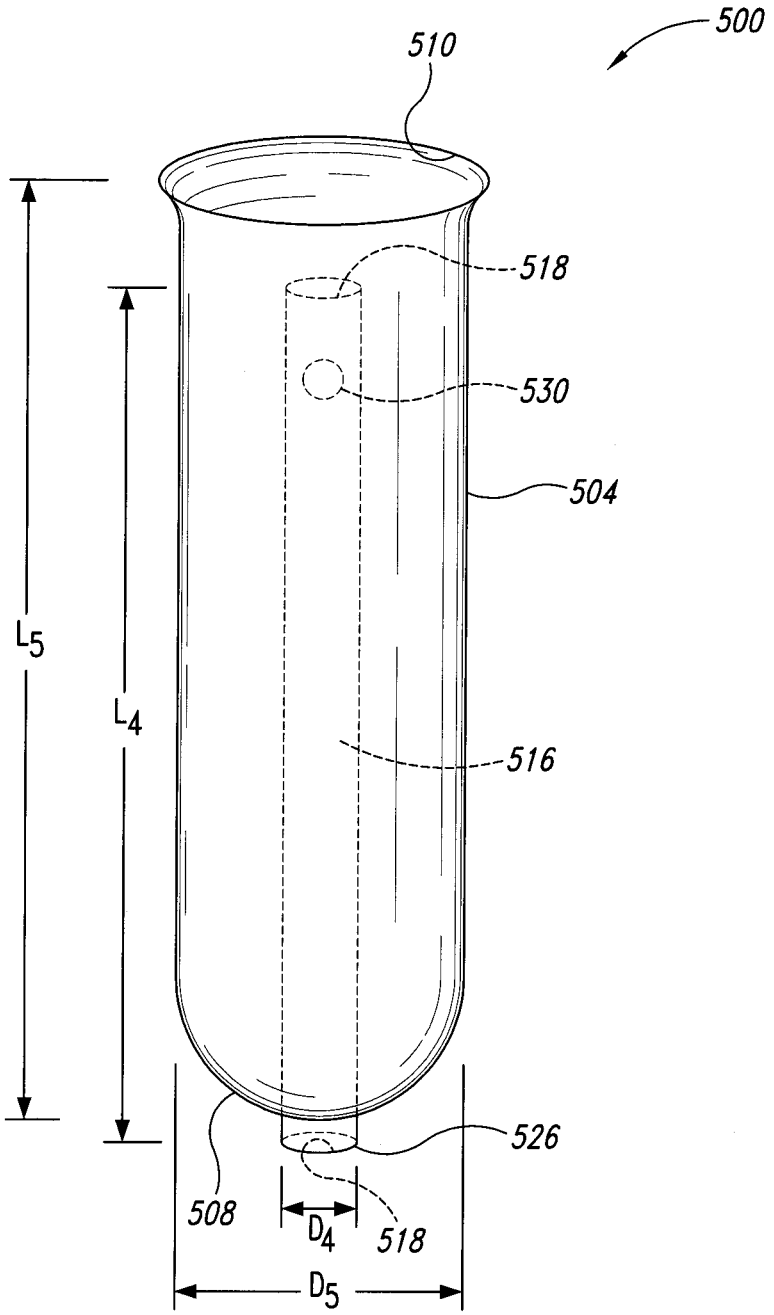
FIG. 5 is an isometric view of an indicator having a hollow inner tube configured in accordance with a further embodiment of the disclosure.

FIG. 5 is an isometric view of an embodiment of an indicator 500 having a hollow inner tube 516 running through a vessel 504. The hollow inner tube 516 has an opening 518 on each end. The hollow inner tube 516 serves as a placement mechanism for the indicator 500. The inner tube 516 is sized to be placed over a post (not pictured) of a dishwasher rack. The post serves to support the indicator 500 in an upright position. The post may be attachable to the dishwasher rack or may be an integral component thereof. The inner tube 516 has a diameter $D_4$ at least as large as slightly greater than the diameter of the dishwasher post to allow for sufficient clearance for ready removal of the indicator 500 from the post. In one embodiment, the inner tube 516 has a diameter $D_4$ ranging from about 0.2 to about 0.7 inch.

In the illustrated embodiment, the vessel 504 is tube-shaped, but in other embodiments may be cup-shaped, conical, or another shape altogether. In the illustrated embodiment, the hollow inner tube 516 has a length $L_4$ that runs from a point below an opening 510 on one end of the vessel 504 to a point beyond a base 508 on the other end of the vessel 504. In other embodiments, the inner tube 516 may be shorter or longer as compared to the length $L_5$ of the vessel 504. The openings 518 of the inner tube 516 can be below, equal to, or above the respective opening 510 and base 508 of the vessel 504. In one embodiment, for example, the upper opening 518 of the hollow inner tube 516 is from about 0.1 to about 0.8 inch below the opening 510 of the vessel 504, with the result that any water standing in the vessel 504 after the dishwashing cycle is complete drains to the level of the inner tube 516. In this embodiment, the vessel 504 cannot be filled up to its opening 510, and water is less likely to unintentionally spill when the indicator 500 is being emptied by the user after all clean dishes have been unloaded from the dishwasher. The inner tube 516 can optionally include one or more apertures 530 to reduce the water level in the vessel 504 to the level of the apertures 530. In one embodiment, the length $L_5$ of the vessel 504 is from about 2 inches to about 8 inches. In one embodiment, the inner tube 516 has a length $L_4$ from about 0.1 to about 0.75 inch shorter than the length $L_5$ of the vessel 504.

The vessel 504 has a diameter $D_5$ larger than the diameter of the inner tube 516. The diameter $D_5$ of the vessel 504 can vary in different embodiments of the disclosure, ranging from slightly larger than the diameter $D_4$ of the inner tube 516 to approximately the diameter of a drinking glass. Considerations in choosing a diameter $D_5$ of the vessel 504 include visibility and dishwasher space constraints. A vessel 504 with a greater diameter $D_5$ allows more water to pool in the vessel 504 during the cycle and makes reading the indicator 500 easier. However, it is not ideal to have the indicator 500 take up more dishwasher space than necessary, as having an excessively large indicator 500 reduces the number of dirty dishes that can be run in a cycle.

Figure 6A:
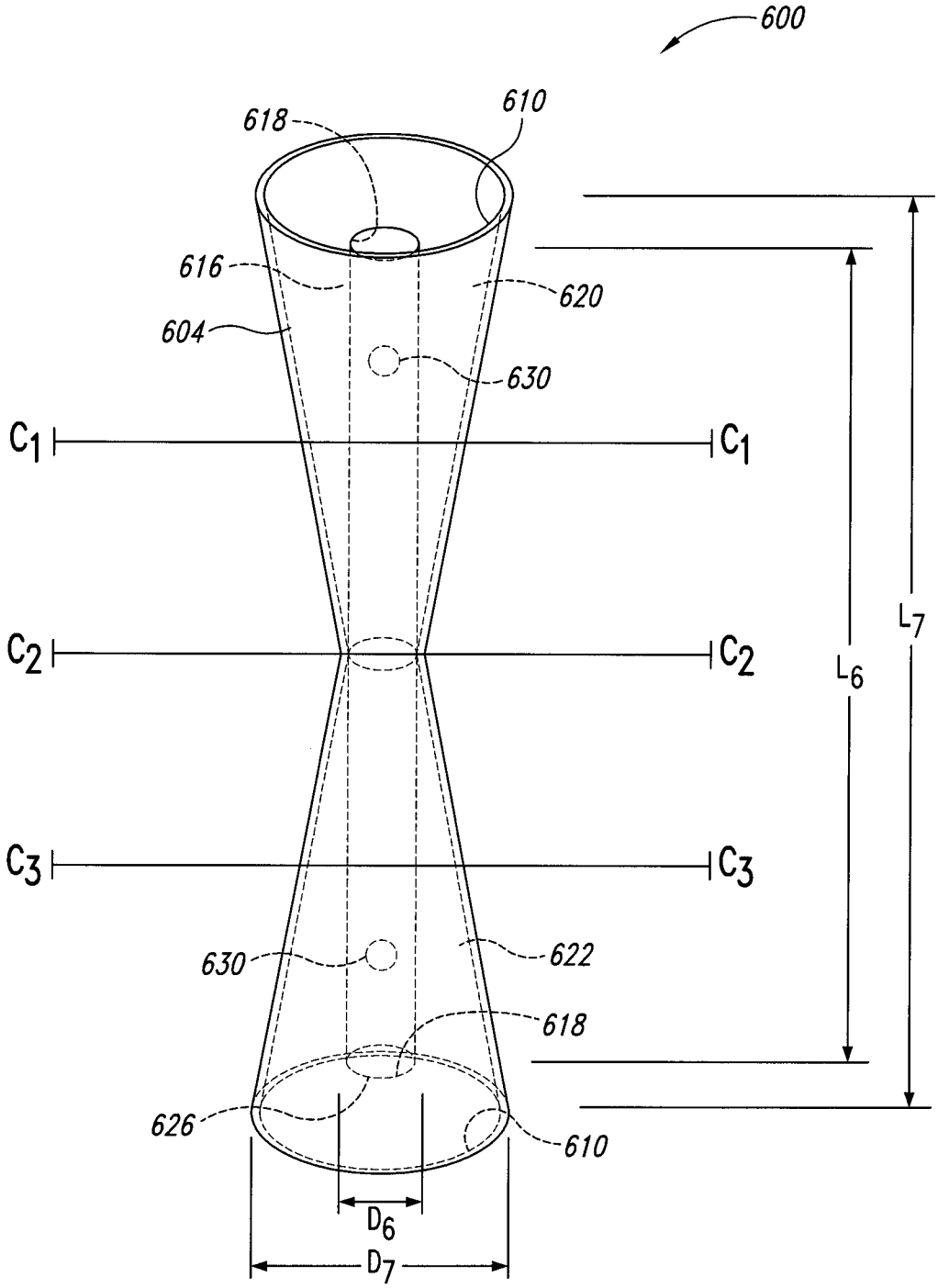
FIG. 6A is an isometric view of an indicator having a multi-compartment vessel and an inner tube configured in accordance with yet another embodiment of the disclosure.

FIG. 6A is an isometric view of an alternate embodiment of an indicator 600. In this embodiment, the indicator 600 includes a hollow inner tube 616 running through a multi-compartment vessel 604. In the illustrated embodiment, the hollow inner tube 616 is cylinder-shaped, but may take on other shapes in other embodiments. The hollow inner tube 616 can include an opening 618 on each end. The multi-compartment vessel 604 has a first compartment 620 and a second compartment 622. Each of the compartments 620, 622 can have an opening 610. In the illustrated embodiment, the multi-compartment vessel 604 is hourglass shaped, but may take on other shapes in other embodiments.

Figure 6B:
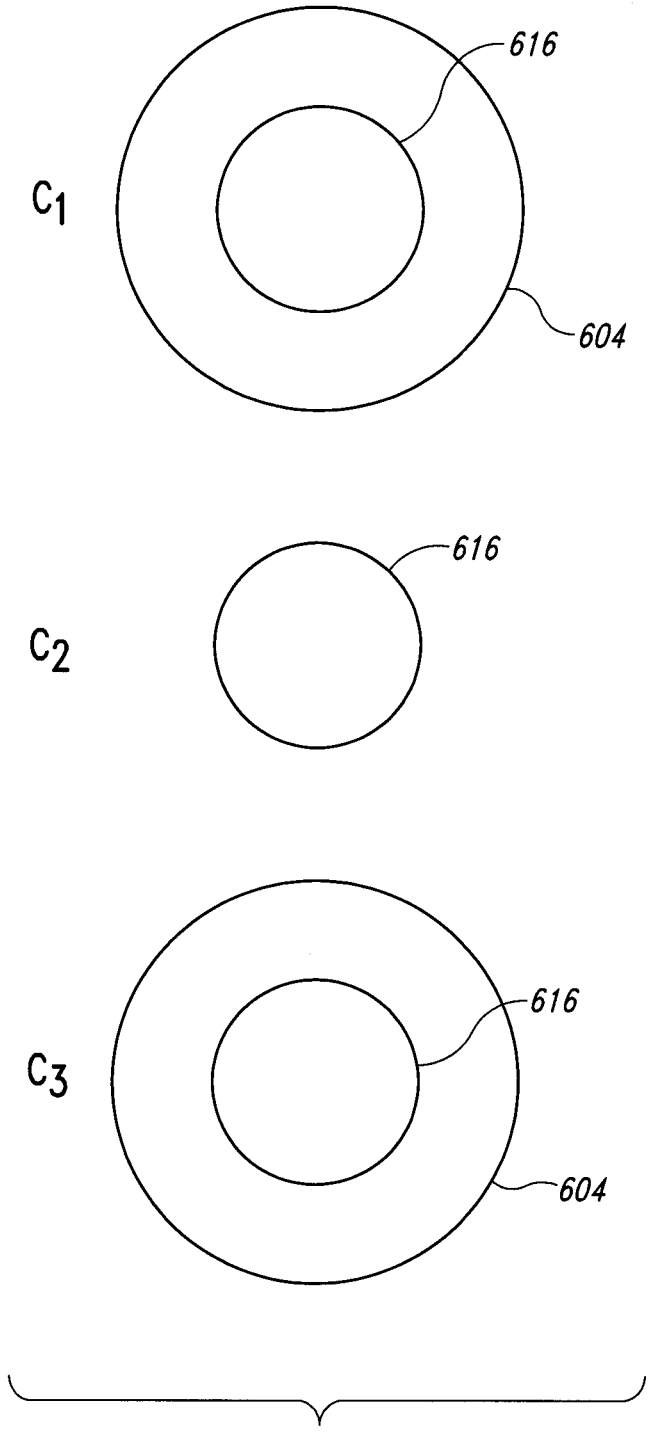
FIG. 6B includes three cross-sectional views of the indicator shown in FIG. 6A.

The cross-sections $C_1$, $C_2$, and $C_3$ at three points along the indicator 600 illustrated in FIG. 6A are shown in FIG. 6B. Referring to FIGS. 6A and 6B together, in the illustrated embodiment, the first and second compartments 620, 622 can be separated from one another at the midpoint cross-section line $C_2$, so no fluid standing in the first compartment 620 can flow into the second compartment 622. Furthermore, the first 620 and second 622 compartments of this embodiment of the indicator 600 are symmetrical about the midpoint cross-section line $C_2$, so the vertical orientation of the device is interchangeable—either the first 620 or second 622 compartment may be treated as a "top" compartment when the indicator 600 is vertically oriented.

The hollow inner tube 616 can serve as a placement mechanism for the indicator 600, in a manner similar to the inner tube 516 described with reference to FIG. 5 above. The inner tube 616 can be sized to be placed over a post (not pictured) on an interior portion of a dishwasher rack. The post can serve to support the indicator 600 in an upright position. The post may be attachable to the dishwasher rack or may be an integral component thereof. The inner tube 616 has a diameter $D_6$ at least as large as slightly greater than the diameter of the dishwasher post. In one embodiment, the inner tube 616 has a diameter $D_6$ ranging from about 0.2 to about 0.7 inch. The openings 610 of the multi-compartment vessel 604 can have a diameter $D_7$ larger than the diameter $D_6$ of the inner tube 616. The diameter $D_7$ of the multi-compartment vessel 604 can vary in different embodiments of the disclosure, ranging from slightly larger than the diameter $D_6$ of the inner tube 616 to approximately the diameter of a drinking glass.

In the illustrated embodiment, the openings 618 of the inner tube 616 can be below, equal to, or above the respective openings 610 of the vessel 604. In one embodiment, for example, the upper opening 618 of the hollow inner tube 616 is from about 0.1 to about 0.8 inch below the upper opening 610 of the vessel 604 and the lower opening 618 of the hollow inner tube 616 is from about 0.1 to about 0.8 inch above the lower opening 610 of the vessel 604. In this embodiment the inner tube 616 can serve the same water-draining function as the inner tube 516 described with reference to FIG. 5. In other embodiments, the openings 618 of the inner tube 616 can be at equal heights with or can extend beyond the openings 610 of the vessel 604. The inner tube 616 can optionally include one or more apertures 630 to reduce the water level in the vessel 604 to the level of the apertures 630. In one embodiment, the vessel 604 can have a length $L_7$ from about 2 inches to about 8 inches. In one embodiment, the inner tube 616 can have a length $L_6$ from about 0.1 to about 0.75 inch less than the length $L_7$ of the vessel 604

Figure 7:
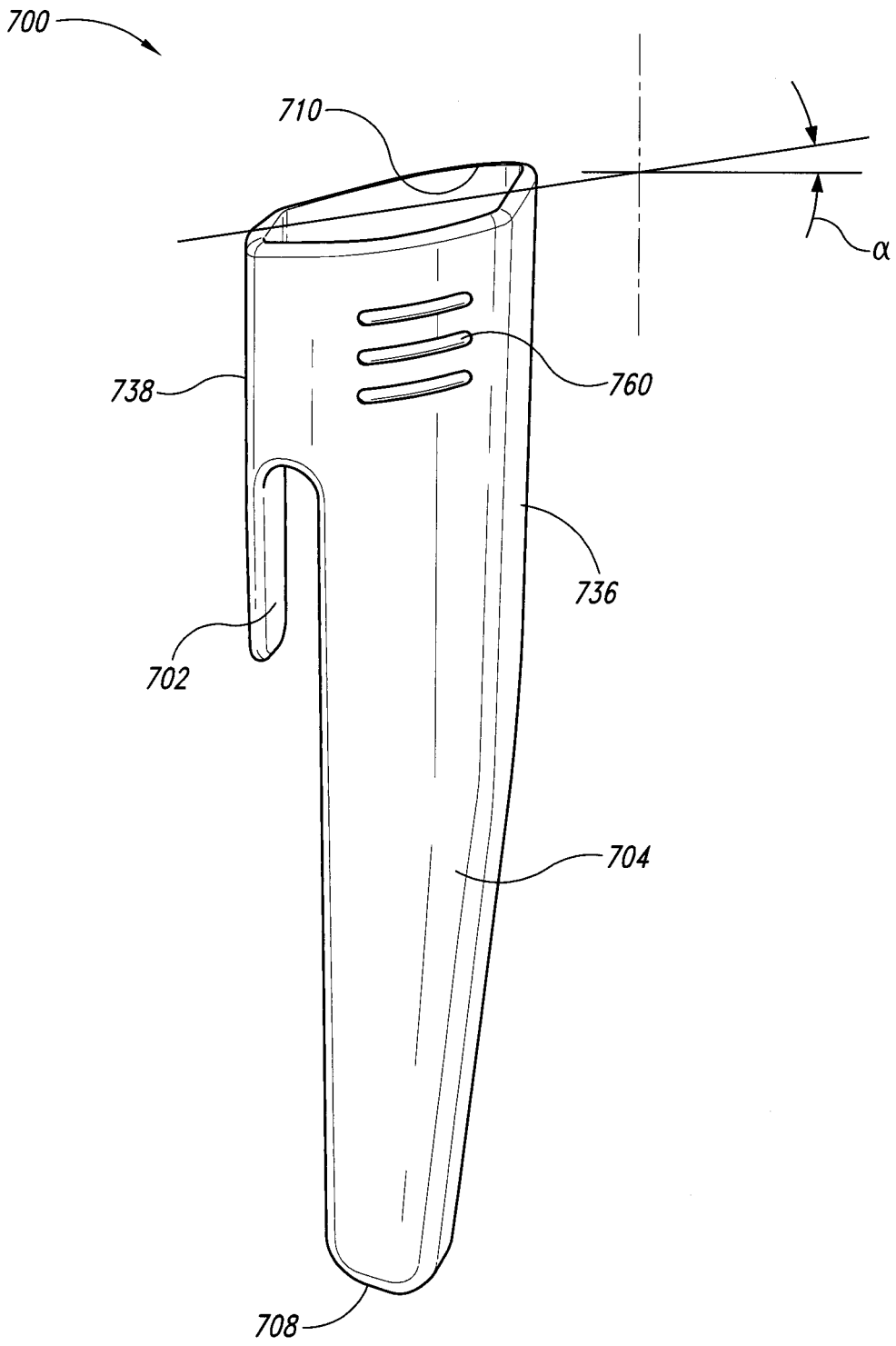
FIG. 7 is an isometric view of a dishwasher status indicator having an integrated hook and vessel configured in accordance with another embodiment of the disclosure.

FIG. 7 is an isometric view of a dishwasher status indicator 700 configured in accordance with another embodiment of the disclosure. The indicator 700 has several features generally similar to the indicators described above with reference to FIGS. 1-6B. For example, the indicator 700 includes a vessel 704 and an attachment mechanism, feature, or portion, such as a hook 702. The hook 702 is configured to removeably attach the vessel to a dishwasher rack, utensil basket, etc. In the illustrated embodiment, the indicator 700 comprises a single unit having an integral hook 702 and vessel 704. In several embodiments, the indicator 700 is an injected-molded plastic, such as plastic that is transparent or at least partially transparent.

In some embodiments, at least a portion of the hook 702 is generally parallel to the vessel 704 and is spaced apart from the vessel 704 by a distance sufficient to accommodate a dishwasher rack. In some embodiments, this distance can be from about ⅛ inch to about ½ inch. In several embodiments, this distance is ¼ inch. As described above, the length of the hook 702 can vary in different embodiments of the disclosure. The indicator 700 can be tinted different colors, and can have varying degrees of transparency.

In the illustrated embodiment, the vessel 704 includes a first sidewall surface 736 and a second sidewall surface 738 opposite the first sidewall surface 736. The vessel 704 further includes an opening 710 at one end and a closed base 708 at the other end. In some embodiments, the vessel 704 is tapered for at least part of the length between the opening 710 and the base 708 so that the base 708 has a smaller cross-sectional width than the opening 710. This tapering can enhance the stability of the indicator 700 on a dishwasher rack during a dishwashing cycle. In other embodiments, the vessel 704 may have more or less tapering along more or less of its length, may be tapered with a larger cross-section width at the base 708 than at the opening 710, or the vessel 704 may not be tapered at all. In some embodiments, a small amount of dishwasher detergent can form a residue in the base 708 of the indicator 700 during the dishwashing cycle. This residue can serve as a contraster feature to enable a user to quickly ascertain whether there is fluid in the vessel 704.

The opening 710 of the vessel 704 can be angled relative to a horizontal plane (illustrated as angle $\alpha$ in FIG. 7) or sloped/slanted from the first sidewall surface 736 to the second sidewall surface 738. In some embodiments, for example, the upper edge of the first sidewall surface 736 at the opening 710 can be about ¼ inch higher than the corresponding edge of the second sidewall surface 738. During the dishwasher cycle, water fills only to the height of the lower edge of the second sidewall surface 738, not to the higher edge of the first sidewall surface 736. Limiting the height of the water volume in the vessel 704 can help reduce undesirable spillage from the vessel 704 when the user moves the dishwasher rack during unloading. Furthermore, the slanted opening 710 can function as an additional contraster feature. More specifically, since the water line falls below the higher first sidewall surface 736, the water line contrasts against the first sidewall surface 736 to enable the user to quickly visually ascertain the clean/dirty status of the dishes.

In the illustrated embodiment, the indicator 700 further includes one or more grip features, or grooves 760 on one or more sides of the vessel 704. The grooves 760 can allow the user to more easily grip and handle the indicator 700. In some embodiments, the grooves 760 can also serve as a visible contraster feature by providing contrast or shadowing against water in the vessel. In further embodiments, various types of grip features, such as protrusions, indents, high-friction materials (e.g., rubber), or other mechanisms can be used to enhance indicator handling. In still further embodiments, the sidewalls can be smooth and the grip features 760 can be omitted.

From the foregoing, it will be appreciated that specific embodiments of the invention have been described herein for purposes of illustration, but that various modifications may be made without deviating from the spirit and scope of the various embodiments of the invention. The various aspects of embodiments described herein can be combined and/or eliminated to provide further embodiments. Further, while various advantages associated with certain embodiments of the invention have been described above in the context of those embodiments, other embodiments may also exhibit such advantages, and not all embodiments need necessarily exhibit such advantages to fall within the scope of the invention. Accordingly, the invention is not limited, except as by the appended claims.

I claim:

1. An indicator for providing a visual indication of whether dishes in a dishwasher are clean or dirty, the indicator comprising:

a hook configured to engage a dishwasher rack; and a vessel coupled to the hook and configured to hold a volume of fluid, wherein the vessel comprises a fluid opening at a first end portion and a closed base at a second end portion opposite the first end portion, and wherein the vessel further comprises a first sidewall adjacent to the hook and a second sidewall opposite the first sidewall, and wherein the fluid opening is sloped from the first sidewall to the second sidewall.

2. The indicator of claim 1 wherein the indicator comprises a single piece of transparent or non-transparent, injection-molded plastic.

3. The indicator of claim 1 wherein the vessel is tapered from the first end portion to the second end portion.

* * * * *